US010392950B2

(12) United States Patent
Correia et al.

(10) Patent No.: US 10,392,950 B2
(45) Date of Patent: Aug. 27, 2019

(54) TURBINE BAND ANTI-CHORDING FLANGES

(71) Applicant: General Electric Company, Schenectady, NY (US)

(72) Inventors: Victor Hugo Silva Correia, Milton Mills, NH (US); Brian Kenneth Corsetti, Stoneham, MA (US); Mark Broomer, Boston, MA (US)

(73) Assignee: General Electric Company, Schenectady, NY (US)

( * ) Notice: Subject to any disclaimer, the term of this patent is extended or adjusted under 35 U.S.C. 154(b) by 700 days.

(21) Appl. No.: 14/706,003

(22) Filed: May 7, 2015

(65) Prior Publication Data

US 2017/0058684 A1 Mar. 2, 2017

(51) Int. Cl.
*F01D 9/04* (2006.01)
*F01D 25/24* (2006.01)
(Continued)

(52) U.S. Cl.
CPC ..... *F01D 9/041* (2013.01); *F01D 9/04* (2013.01); *F01D 25/005* (2013.01); *F01D 25/10* (2013.01);
(Continued)

(58) Field of Classification Search
CPC .... F01D 9/041; F01D 25/246; F05D 2240/11; F05D 2240/91
See application file for complete search history.

(56) References Cited

U.S. PATENT DOCUMENTS 4,146,352 A 3/1979 Yasugahira et al.
4,187,054 A 2/1980 Landis, Jr. et al.
(Continued)

FOREIGN PATENT DOCUMENTS

EP 1413831 A1 4/2004
EP 2514929 A2 10/2012
(Continued)

OTHER PUBLICATIONS

European Search Report and Opinion issued in connection with corresponding EP Application No. 16168395.8 dated Oct. 19, 2016.
(Continued)

*Primary Examiner* — Ninh H. Nguyen
(74) *Attorney, Agent, or Firm* — General Electric Company; Pamela Kachur

(57) ABSTRACT

A gas turbine engine arcuate segment includes arcuate flange with anti-chording means extending away from annular wall. Anti-chording means may include insert in or bonded to flange and made of different alpha material than the annular wall. Anti-chording means may be heating means for heating flange. Heating means includes hot air inlet to and an outlet from a circumferentially extending heating flow passage embedded in flange and may further include a cold air inlet to heating flow passage. Heating flow passage may be a serpentine heating flow passage with an undulating heating flowpath. A turbine nozzle segment includes one or more airfoils extending radially between inner and outer arcuate band segments and forward and aft outer flanges extending radially from the outer arcuate band segment include anti-chording means. An arcuate turbine shroud segment includes forward and aft shroud rail segments with anti-chording means.

12 Claims, 10 Drawing Sheets

(51) Int. Cl.
*F01D 25/00* (2006.01)
*F01D 25/10* (2006.01)

(52) U.S. Cl.
CPC ..... *F01D 25/246* (2013.01); *F05D 2220/32* (2013.01); *F05D 2240/11* (2013.01); *F05D 2240/128* (2013.01); *F05D 2240/91* (2013.01); *F05D 2250/185* (2013.01); *F05D 2260/2212* (2013.01); *F05D 2260/22141* (2013.01); *F05D 2260/941* (2013.01); *F05D 2300/50212* (2013.01)

(56) References Cited

U.S. PATENT DOCUMENTS 5,071,313 A * 12/1991 Nichols ..... F01D 11/08 415/134
5,098,257 A * 3/1992 Hultgren ..... F01D 5/18 415/115
5,423,659 A 6/1995 Thompson
5,605,437 A * 2/1997 Meylan ..... F01D 11/24 415/1
6,394,749 B2 5/2002 Yu et al.
6,464,457 B1 10/2002 Morgan et al.
6,662,568 B2 12/2003 Shimizu et al.
6,726,446 B2 4/2004 Arilla et al.
6,769,865 B2 8/2004 Kress et al.
7,172,388 B2 * 2/2007 Synnott ..... F01D 11/003 277/637
7,434,402 B2 * 10/2008 Paprotna ..... F01D 11/24 415/115
7,448,846 B2 11/2008 Ruthermeyer et al.
7,753,643 B2 * 7/2010 Gonzalez ..... F01D 9/04 415/1
7,798,775 B2 * 9/2010 Kammel ..... F01D 9/041 248/205.5
8,292,573 B2 * 10/2012 Broomer ..... F01D 9/041 415/178
8,328,511 B2 12/2012 Hernandez Russe et al.
8,920,109 B2 * 12/2014 Tham ..... F02C 9/16 415/108
2004/0074239 A1 4/2004 Tiemann
2009/0010755 A1 1/2009 Keller et al.
2010/0284800 A1 11/2010 Sewall et al.
2015/0016947 A1 1/2015 Kwon
2015/0192032 A1 7/2015 Elisseeff et al.

FOREIGN PATENT DOCUMENTS

FR 1084065 A 1/1955
FR 2993317 A1 1/2014
JP 5254809 A 5/1977
JP 2000352301 A 12/2000
JP 2003014237 A 1/2003
JP 2004517246 A 6/2004
JP 2007046607 A 2/2007
JP 2011208624 A 10/2011

OTHER PUBLICATIONS

Japanese Office Action issued in connection with corresponding JP application No. 2016088651 dated May 9, 2017.
Chinese Office Action issued in connection with corresponding CN application No. 201610295389.6 dated Jul. 12, 2017.
Office Action issued in connection with corresponding CN Application No. 201610295389.6 dated Feb. 9, 2018.

* cited by examiner

TURBINE BAND ANTI-CHORDING FLANGES

BACKGROUND OF THE INVENTION

Technical Field

The present invention relates generally to gas turbine engine turbine segments having flanges attached to bands such as nozzle segments and shroud segments and, more specifically, chording of bands in such turbine segments shrouds.

Background Information

In a typical gas turbine engine, air is compressed in a compressor and mixed with fuel and ignited in a combustor for generating hot combustion gases. The gases flow downstream through a high pressure turbine (HPT) having one or more stages including one or more HPT turbine nozzles, shrouds, and rows of HPT rotor blades. The gases then flow to a low pressure turbine (LPT) which typically includes multi-stages with respective LPT turbine nozzles, shrouds, and LPT rotor blades. The HPT and LPT turbine nozzles include a plurality of circumferentially spaced apart stationary nozzle vanes extending radially between outer and inner bands. Typically, each nozzle vane is a hollow airfoil which cooling air is passed through. Cooling air for each vane can be fed through a single spoolie located radially outwardly of the outer band of the nozzle. In some vanes subjected to higher temperatures, such as the HPT vanes for example, an impingement baffle may be inserted in each hollow airfoil to supply cooling air to the airfoil.

The turbine rotor stage includes a plurality of circumferentially spaced apart rotor blades extending radially outwardly from a rotor disk. Turbine nozzles are located axially forward of a turbine rotor stage. The turbine shrouds are located radially outward from the tips of the turbine rotor blades so as to form a radial clearance between the rotor blades and the shrouds. The shrouds are held in position by shroud hangers which are supported by flanges engaging with annular casing flanges.

The turbine nozzles, shrouds, and shroud hangers are typically formed in arcuate segments. Each nozzle segment typically has two or more vanes joined between an outer band segment and an inner band segment. Each nozzle segment and shroud hanger segment is typically supported at its radially outer end by flanges attached to an annular outer and/or inner casing. Each vane has a cooled airfoil disposed between radially inner and outer band panels which form the inner and outer bands. In some designs, the airfoil, inner and outer band portions, flange portion, and intake duct are cast together such that the vane is a single casting. In some other designs, the vane airfoils are inserted in corresponding openings in the outer band and the inner band and brazed along interfaces to form the nozzle segment.

Turbine nozzles experience high stresses at the interface of the airfoil to the bands predominantly at the trail edge. The high stress results in cracking at these locations. One of the highest contributors to this stress is the chording which occurs on the bands due to the high temperature at the band flowpath combating the colder temperatures on the non-flowpath sides of the bands, particularly the flanges. Chording of the bands is bowing away from the flowpath. The chording associated with the bands imparts a stress at the airfoil band interface.

Certain two-stage turbines have a cantilevered second stage nozzle mounted and cantilevered from the outer band. There is little or no access between first and second stage rotor disks to secure the segment at the inner band. Typical second stage nozzle segments are configured with multiple airfoil or vane segments. Two vane designs, referred to as doublets, are a common design. Three vane designs, referred to as Triplets, are also used in some gas turbine engines. Doublets and Triplets offer performance advantages in reducing split-line leakage flow between vane segments. However, the longer chord length of the bands and mounting structure compromises the durability of the multiple vane nozzle segments. The longer chord length causes an increase of chording stresses due to the higher displacement of the longer chord length activated by the radial thermal gradient through the band. The increased thermal stress may reduce the durability of the turbine vane segment. Similarly, thermal stresses are present in turbine shroud segments and shroud hangers.

It is desirable to have turbine arcuate segments having flanges attached to bands that reduce chording and chording associated stresses. It is desirable to have turbine engine components such as the turbine nozzle arcuate segments and shroud arcuate segments having flanges attached to bands that reduce chording and chording associated stresses. It is desirable to have turbine engine components such as the turbine nozzle arcuate segments and shroud arcuate segments having flanges attached that reduce chording.

BRIEF DESCRIPTION OF THE INVENTION

A gas turbine engine arcuate segment includes an arcuate flange extending radially away from an annular wall and the flange includes an anti-chording means for counteracting chording.

The anti-chording means may include one or more arcuate inserts in or bonded to the flange and made of a different alpha material than that of the annular wall wherein alpha is a coefficient of thermal expansion. The one or more arcuate inserts may extend axially all the way through the flange and may extend radially to a perimeter of the flange. The one or more arcuate inserts may have a dovetail shape disposed in one or more dovetail slots respectively in the flange circumferentially between two dovetail posts of the flange.

The anti-chording means may include a heating means for heating the arcuate flange. The heating means may include a circumferentially extending heating flow passage embedded in the arcuate flange, a hot air inlet to the heating flow passage, and an outlet from the heating flow passage. The heating means may include a cold air inlet to the heating flow passage, the hot and cold air inlets operable to flow heating air through the heating flow passage, and the hot air inlet and the cold air inlet operable to moderate a temperature of the heating air in the heating flow passage.

Turbulators or pins may extend downwardly and upwardly from upper and lower walls bounding the heating flow passage.

The circumferentially extending heating flow passage may be a serpentine heating flow passage with an undulating heating flowpath and may include alternating upper and lower ribs extending downwardly and upwardly from upper and lower walls respectively bounding the serpentine heating flow passage.

The gas turbine engine arcuate segment may include turbine nozzle throats adjacent leading and trailing airfoils, the hot air inlet located near a pressure side of the trailing airfoil near a first one of the turbine nozzle throats, and the outlet located near a suction side of the leading airfoil near a second one of the turbine nozzle throats.

A turbine nozzle segment includes one or more airfoils extending radially between inner and outer arcuate band segments of the turbine nozzle segment, arcuate forward and aft outer flanges extending radially outwardly from the outer arcuate band segment at corresponding forward and aft ends respectively of the outer band segment, and each of the forward and aft outer flanges includes one of the anti-chording means. The turbine nozzle segment may further include arcuate forward and aft inner flanges extending radially inwardly from the inner arcuate band segment at corresponding forward and aft ends respectively of the inner band segment and at least one of the forward and aft inner flanges includes a corresponding one of the anti-chording means.

The gas turbine engine arcuate segment may be an arcuate turbine shroud segment including forward and aft shroud rail segments extending radially outwardly from the arcuate shroud band segment wherein the forward and aft shroud rail segments include the flange, forward and aft shroud hooks on the forward and aft shroud rail segments, and the anti-chording means is disposed in at least one of the forward and aft shroud rail segments.

A turbine nozzle includes a plurality of gas turbine engine arcuate turbine nozzle segments, each of the turbine nozzle segments including an arcuate flange extending radially away from an annular wall, the flange including an anti-chording means for counteracting chording, the anti-chording means including a ring segment extending circumferentially between circumferentially spaced apart first and second edges of and bonded or attached to the annular wall or flange of each of the turbine nozzle segments, and the ring segment being made of a different alpha material than that of the annular wall wherein alpha is a coefficient of thermal expansion.

BRIEF DESCRIPTION OF THE DRAWINGS

The subject matter which is regarded as the invention is particularly pointed out and distinctly claimed in the concluding part of the specification. The invention, in accordance with preferred and exemplary embodiments, together with further objects and advantages thereof, is described in the following detailed description taken in conjunction with the accompanying drawings in which:

DETAILED DESCRIPTION OF THE INVENTION

Figure 1:
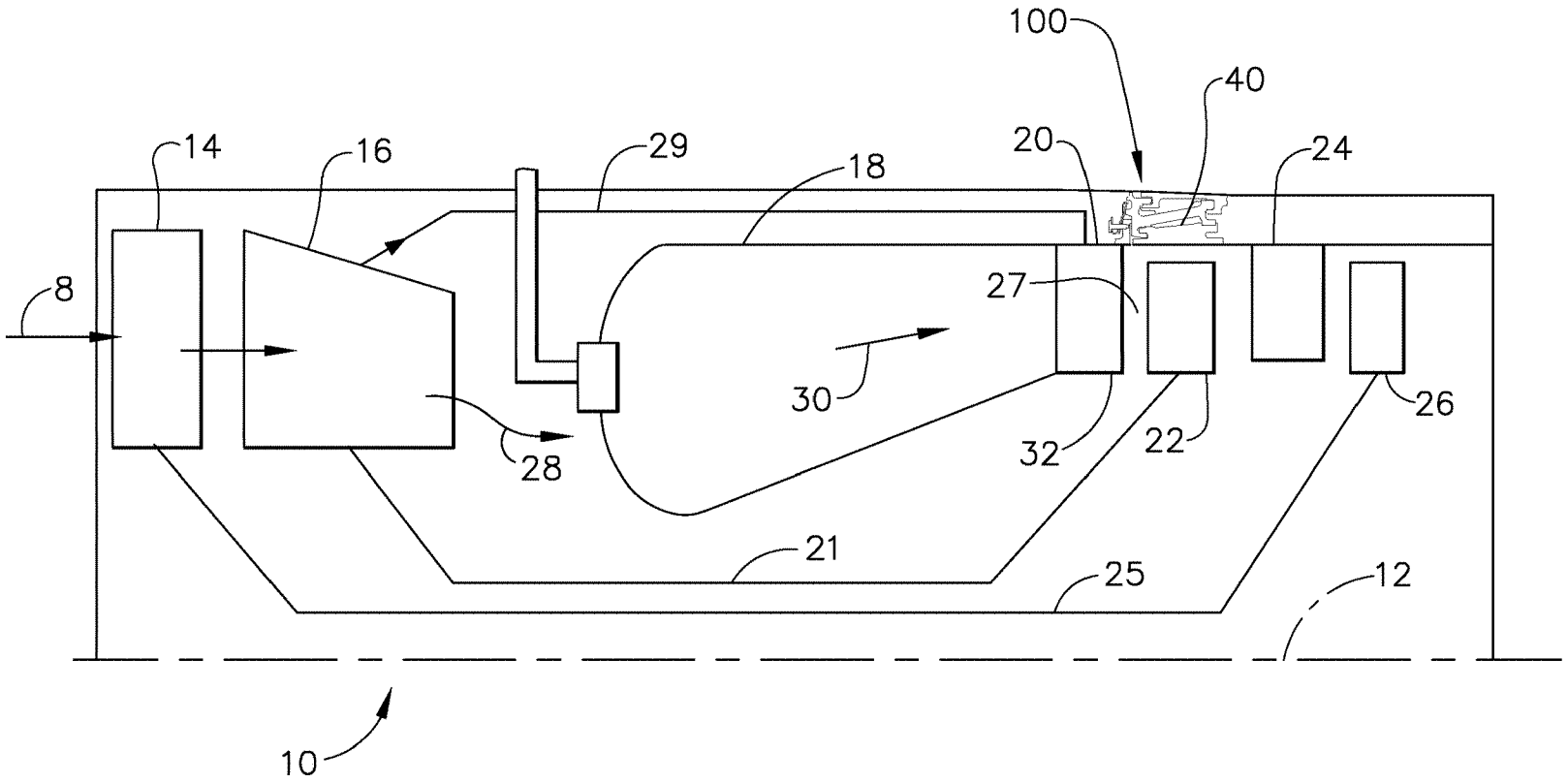
FIG. 1 is a schematic illustration of an exemplary aircraft turbofan gas turbine engine.

Illustrated schematically in FIG. 1 is a portion of an exemplary aircraft turbofan gas turbine engine 10 circumscribed about a longitudinal or axial centerline axis 12. The engine 10 includes, in serial flow communication, a fan 14, multistage axial high pressure compressor 16, annular combustor 18, high pressure turbine nozzle 20, a single stage high pressure turbine rotor 22, and one or more stages of low pressure turbine nozzles 24 and low pressure turbine rotors 26. The high pressure turbine rotor 22 is joined to the compressor 16 by a first shaft 21 and a low pressure turbine rotor 26 is joined to the fan 14 by a second coaxial shaft 25. During operation, ambient air 8 flows downstream through the fan 14, the compressor 16 from where it exits as compressed air 28 and is then flowed into the combustor 18. The compressed air 28 is mixed with fuel and ignited in the combustor 18 generating hot combustion gases 30 which flow downstream through turbine stages which extract energy therefrom for powering both the fan 14 and the compressor 16.

Figure 2:
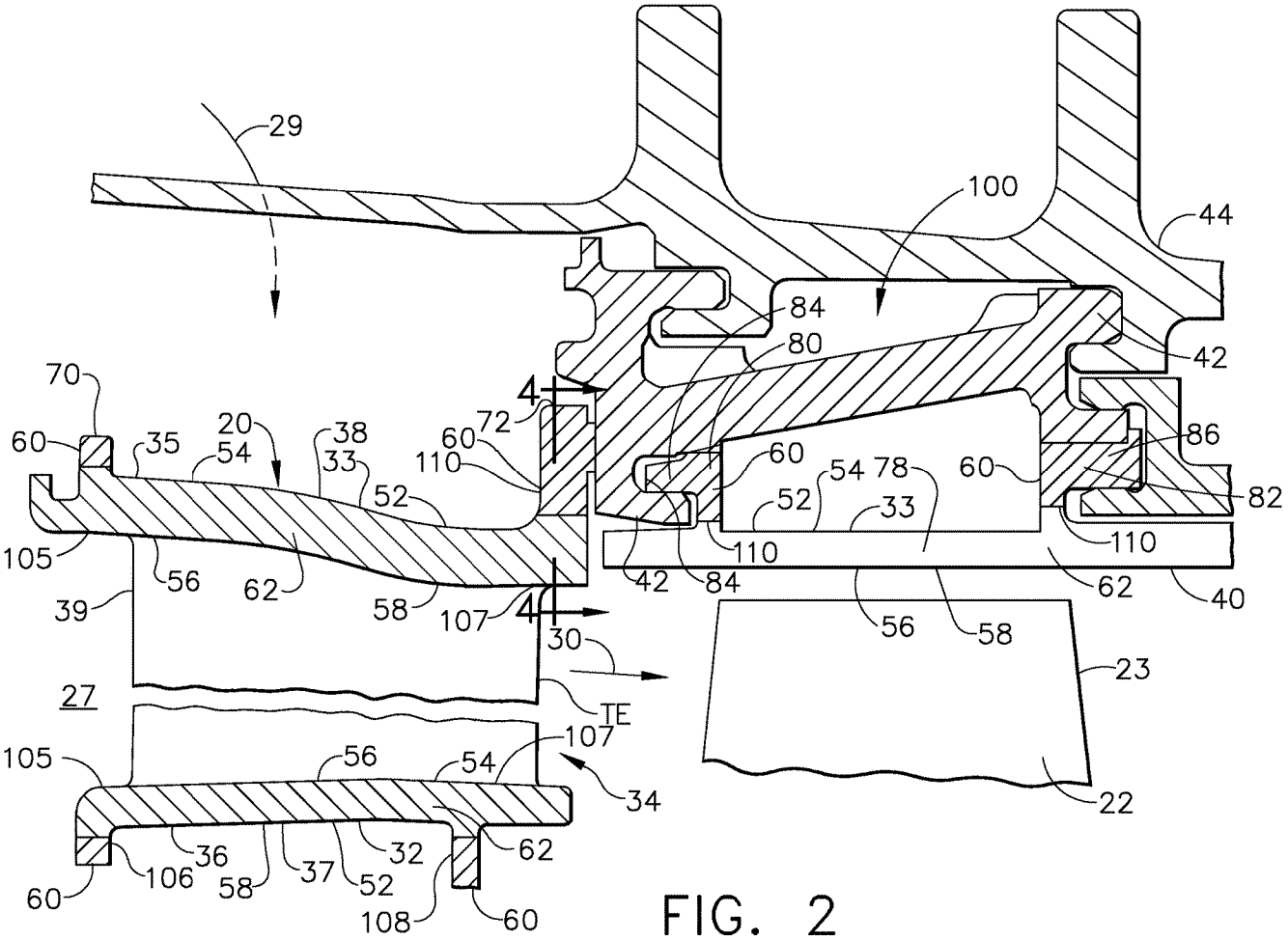
FIG. 2 is a longitudinal cross-sectional view illustration of a nozzle segment and shroud segment illustrated in FIG. 1 including first exemplary embodiments of anti-chording flanges.

Referring to FIGS. 1 and 2, various stator and rotor annular turbine components 200 of the turbines downstream from the combustor 18 define a turbine flowpath 27 which channels the hot combustion gases 30 therethrough for discharge from the engine. Downstream of and adjacent to the high pressure turbine nozzle 20 is the high pressure turbine rotor 22. The rotor 22 may take any conventional form having a plurality of circumferentially spaced apart turbine blades 23 extending radially outwardly from a rotor disk for extracting energy from the gases 30 and powering the compressor 16. A portion of the compressed air 28 is bled from the compressor 16 to provide bleed air which can be used as cooling air 29 which is channeled to various parts of the turbines such as the high pressure nozzle 20 to provide cooling thereof. The cooling air 29 is channeled around and through the high pressure turbine nozzle 20 at a substantially higher pressure than that of the combustion gases 30 flowing therethrough during operation.

Turbine stator components such as high pressure turbine nozzles 20 and shrouds 98 are often manufactured in arcuate segments 33 and then assembled together in the engine 10 forming the turbine components. Various joints or gaps are provided between annular assemblies of arcuate segments 33 which must be suitably sealed for preventing leakage of the high pressure cooling air 29 into the turbine flowpath 27.

Figure 3:
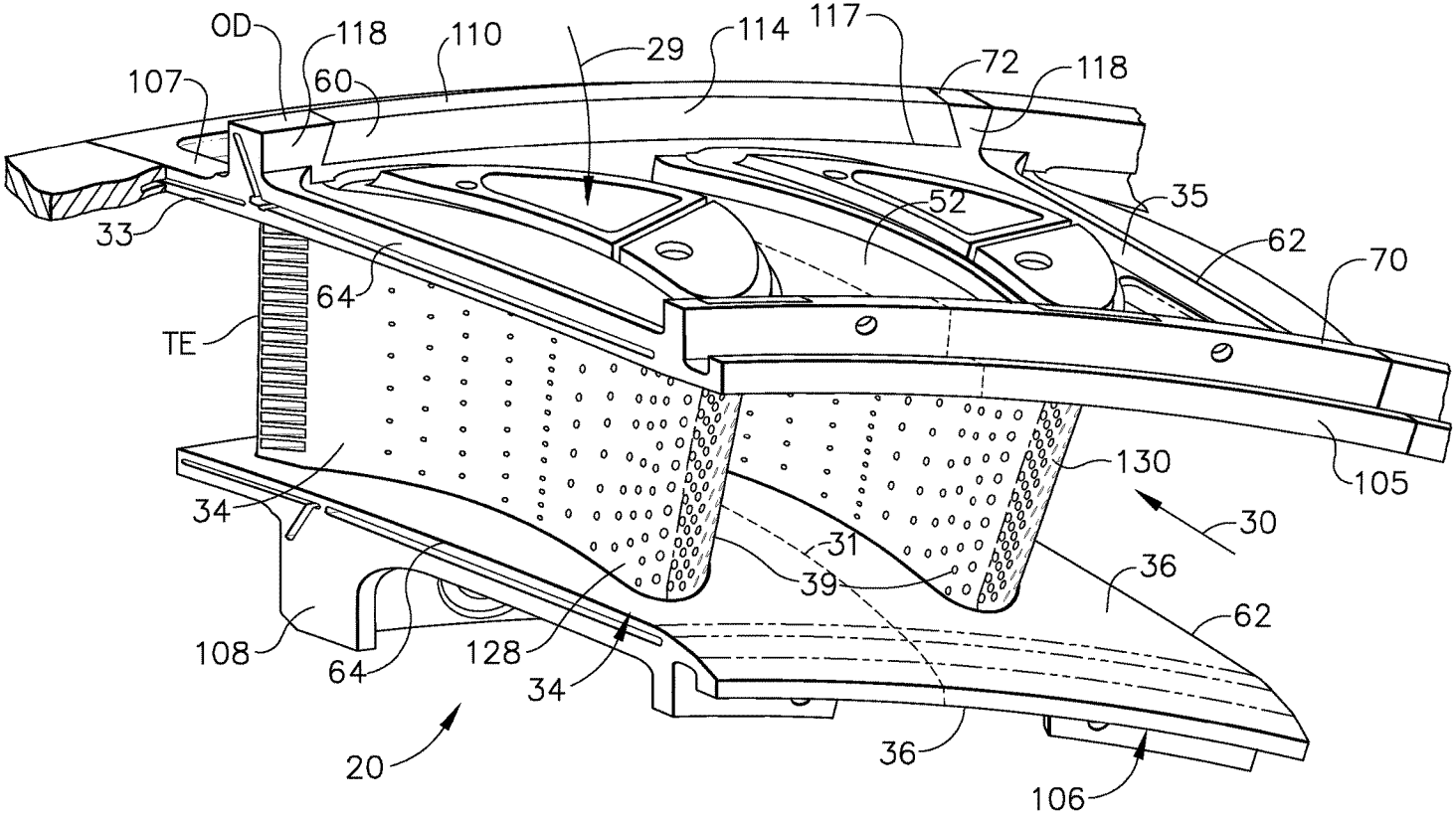
FIG. 3 is a perspective view illustration of the nozzle segment illustrated in FIG. 2.

Illustrated in FIGS. 2 and 3 is an exemplary embodiment of a turbine nozzle segment 32 of the annular high pressure turbine nozzle 20 and an exemplary embodiment of a shroud segment 40 of the annular shroud 98 or stationary shroud assembly 100 which are examples of stationary turbine arcuate segments 33. Circumferentially adjoining nozzle segments 32 are bolted or otherwise joined together to form the full ring annular high pressure turbine nozzle 20. The turbine nozzle segments 32 may be made from one, two, or more vanes or airfoils 34 and may be circumferentially joined together such as by brazing, illustrated by a braze line 31, as illustrated in FIG. 3.

The high pressure turbine nozzle 20 includes an annular segmented radially outer band 35 and a coaxial annular segmented radially inner band 36. The outer and inner bands 35, 36 bound the turbine flowpath 27 in the high pressure turbine nozzle 20. A plurality of circumferentially spaced apart stator airfoils 34 extend radially between and are fixedly joined to the outer and inner bands 35, 36. Pressure and suction sides 41, 43 extend downstream from a leading edge LE to a trailing edge TE of each of the stator airfoils 34.

Each of the nozzle segments 32 includes one or more of the airfoils 34 extending radially between inner and outer arcuate band segments 37, 38. Arcuate forward and aft outer flanges 70, 72 extend radially outwardly from the outer arcuate band segment 38 at corresponding forward and aft ends 105, 107, respectively, of the outer band segment 38. The arcuate forward and aft outer flanges 70, 72 extend circumferentially between circumferentially spaced apart first and second edges 62, 64 of the outer arcuate band segment 38. Arcuate forward and aft inner flanges 106, 108 extend radially inwardly from the inner arcuate band segment 37 at corresponding forward and aft ends 105, 107, respectively, of the inner band segment 37. The arcuate forward and aft inner flanges 106, 108 extend circumferentially between circumferentially spaced apart first and second edges 62, 64 of the inner arcuate band segment 37. Collectively, the radially inner and outer arcuate band segments 37, 38 of the nozzle segments 32 form the segmented annular radially outer and inner bands 35, 36, respectively. The inner surface 135 of the outer band 35 and the outer surface 136 of the inner band 36 define portions of flowpath boundaries for the combustion gases 30 which are channeled downstream to the turbine rotor 22.

Referring to FIGS. 2 and 3, the cooling air 29 is channeled to the nozzle 20 and flows through the individual airfoils 39 for cooling thereof and circulates around the outer surface 136 of the outer band 35. The cooling air 29 is at a higher pressure compared to that of the combustion gases 30 channeled through the nozzle 20. The relatively cold cooling air 29 produces cold surfaces 52 along an outer side 54 of the outer band segment 38. The relatively hot combustion gases 30 in the turbine flowpath 27 produce a hot surface 56 along an inner side 58 of the outer band segment 38. The inner band segment 37 has a cold surface 52 along an inner side 58 of the inner band segment 37. The relatively hot combustion gases 30 in the flowpath 27 produce a hot surface 56 along an outer side 54 of the inner band segment 37. Chording occurs on the band segments due to a thermal gradient associated with the hot combustion gases 30 imparting high temperature on the outer band inner surface and cooling air imparting cold temperatures on the outer surfaces of the outer band. The temperature gradient is exacerbated by the flanges radial height resulting in a higher thermal gradient.

The turbine nozzles 20 experience high stresses at the interface between the airfoils 39 and the band segments, particularly at trailing edges TE of the airfoils 39. The high stress results in cracking at these locations. One of the highest contributors to this stress is chording which occurs on the bands due to the high temperature at the band along the turbine flowpath 27 combating the colder temperatures on the non-flowpath sides of the bands, particularly the flanges. As the band undergoes chording (bowing away from the flowpath), the airfoils are pulled on, resulting in high stresses.

The flanges include an anti-chording means 60 for counteracting chording or flattening. One embodiment of the anti-chording means 60 illustrated herein is in the arcuate aft outer flange 72 at the aft end 107 of the outer band segment 38 of the nozzle segments 32 of the high pressure turbine nozzle 20 as illustrated in FIGS. 2 and 3. This exemplary embodiment of the anti-chording means 60 includes materials in the flanges such as the arcuate aft outer flange 72 having a different coefficient of thermal expansion (alpha) than the rest of the nozzle segment to counteract the chording experienced by the band segments. Inserts 110 made of different alpha material may be inserted in or attached in another manner to the aft outer flange 72 and other flanges such as the forward and aft inner flanges 106, 108 and the forward outer flange 70.

Figure 4:
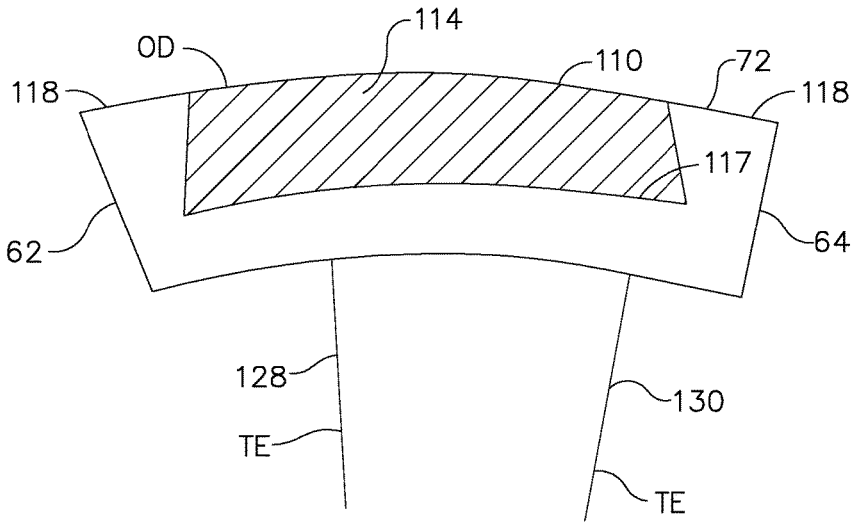
FIG. 4 is a forward looking aft cross sectional schematical view illustration of a flange of the turbine nozzle segment through 4-4 in FIG. 2.

Referring to FIGS. 3 and 4, the insert 110 may be arcuate and made of the different higher alpha material and may have a dovetail shape 114 and be disposed in a dovetail slot 117 in one or more of the flanges. The arcuate insert 110 is illustrated in the aft outer flange 72 as extending axially all the way therethrough. The exemplary arcuate insert 110 illustrated in FIGS. 3 and 4 extend circumferentially between two dovetail posts 118 of the aft outer flange 72. The arcuate insert 110 extends radially through the aft outer flange 72 to a perimeter OD of the aft outer flange 72. A single arcuate insert 110 is illustrated herein but two or more arcuate inserts 110 may be used for each flange. The insert 110 may be brazed or otherwise bonded into the dovetail slot 117. The different alpha metal in the flanges causes the flanges to grow at similar amounts as the hot outer and inner bands 35, 36 thereby reducing band chording. As chording is reduced, the stress on the airfoil is significantly reduced as well.

Referring to FIGS. 1 and 2, adjoining and axially downstream of the outer band 35 is a stationary shroud assembly 100 which bounds and confines the turbine flowpath 27 radially outwardly of the turbine blades 23. The shroud assembly 100 is made from a plurality of circumferentially adjoining arcuate turbine shroud segments 40 supported from a plurality of circumferentially adjoining shroud hangers 42, which in turn are supported from an annular outer casing 44 using forward and aft hooks and retention clips. The shroud segments 40 and hangers 42 are disposed coaxially with the turbine nozzle 20 for defining a radially outer flowpath boundary around the turbine blades 23 along which the combustion gases 30 flow from the nozzle 20.

Arcuate forward and aft shroud rail segments 80, 82 extend radially outwardly from the shroud segments 40. The arcuate forward and aft shroud rail segments 80, 82 extend circumferentially between circumferentially spaced apart first and second edges 62, 64 of the shroud segments 40. Forward and aft shroud hooks 84, 86 on the forward and aft shroud rail segments 80, 82 mount the shroud segments 40 to the shroud hangers 42. In alternate embodiments, the individual shroud segments 40 may be directly mounted to the outer casing 44, but in the exemplary embodiment illustrated herein, the shroud segments 40 are mounted to the shroud hangers 42, which in turn are mounted to the casing 44.

Referring to FIG. 2, the hot combustion gases 30 in the flowpath 27 produce a hot surfaces 56 along inner sides 58 of the shroud segments 40. The shroud segments 40 have cold surfaces 52 along radially outer sides 54 of the shroud segments 40. Chording of the shroud segment 40 occurs due to the high radial thermal gradient along the inner sides 58 of the shroud segments 40 facing the flowpath combating the colder temperatures on the outer sides 54 or non-flowpath sides of the shroud segments 40 and the forward and aft shroud rail segments 80, 82. Anti-chording means 60 for counteracting chording may include one or more arcuate inserts 110 made of a different alpha material (preferably a higher alpha material) inserted in the forward and/or aft shroud rail segments 80, 82.

Each of the inserts 110 may have a dovetail shape 114 and be disposed in a dovetail slot 117 in the forward and/or aft shroud rail segments 80, 82 as illustrated in FIG. 4. The arcuate inserts 110 extends axially all the way through the forward and aft shroud rail segments 80, 82 and circumferentially between two dovetail posts 118 of each of the forward and aft shroud rail segments 80, 82. The arcuate inserts 110 extend radially through the forward and aft shroud rail segments 80, 82 to perimeters OD of the forward and aft shroud rail segments 80, 82. Thus, the arcuate inserts 110 include the forward and aft shroud hooks 84, 86.

Figure 4A:
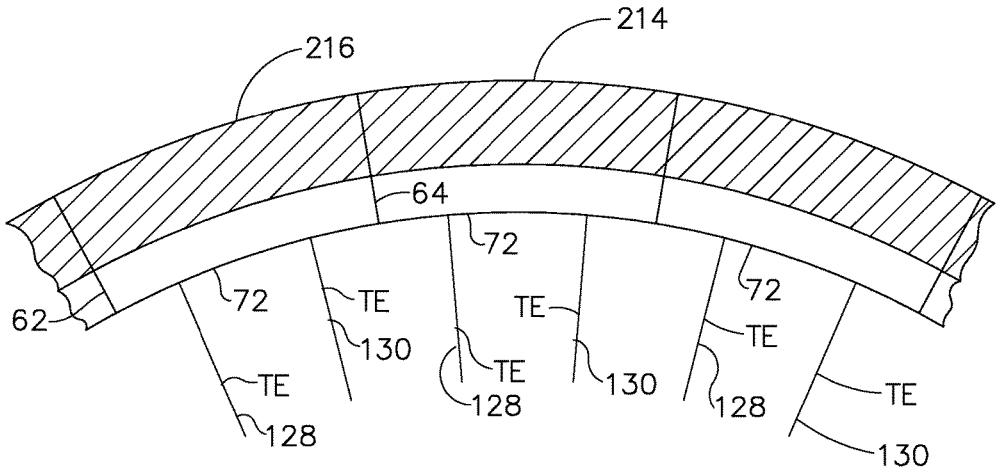
FIG. 4A is a forward looking aft cross sectional schematical view illustration of an anti-chording ring to counteract chording in turbine nozzle segments illustrated in FIG. 2.
Figure 5:
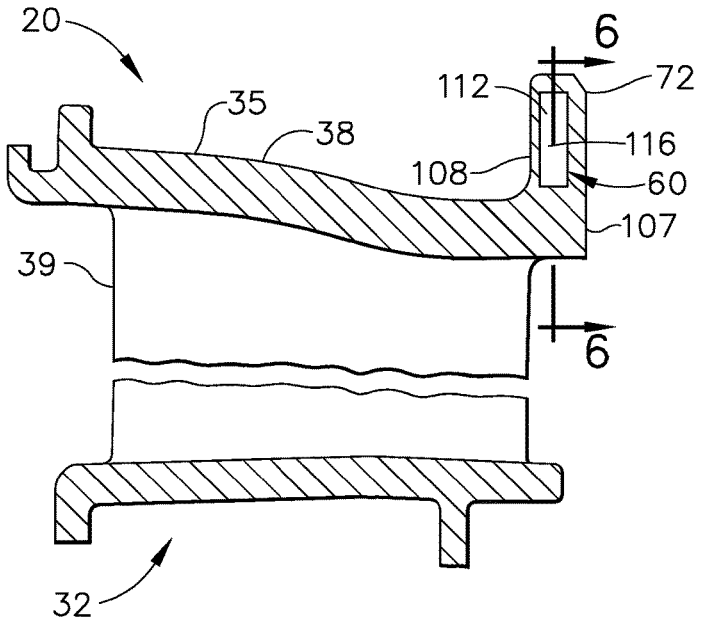
FIG. 5 is a longitudinal cross-sectional view illustration of a turbine nozzle segment in the turbine nozzle illustrated in FIG. 1 including a second exemplary embodiments of an anti-chording flange.
Figure 6:
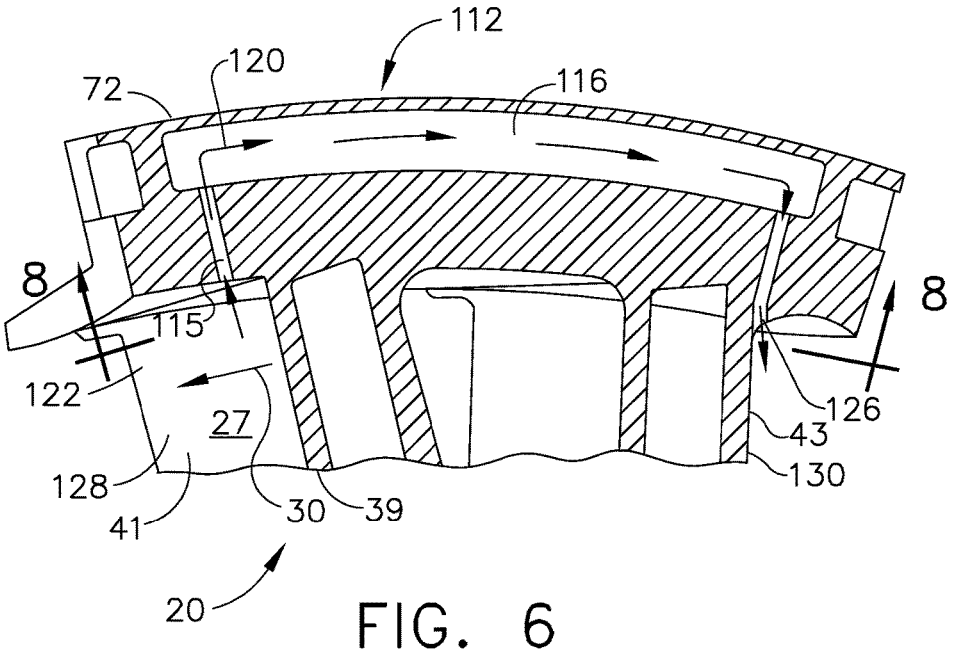
FIG. 6 is a partially cut away perspective view illustration of the flange illustrated in FIG. 5.
Figure 7:
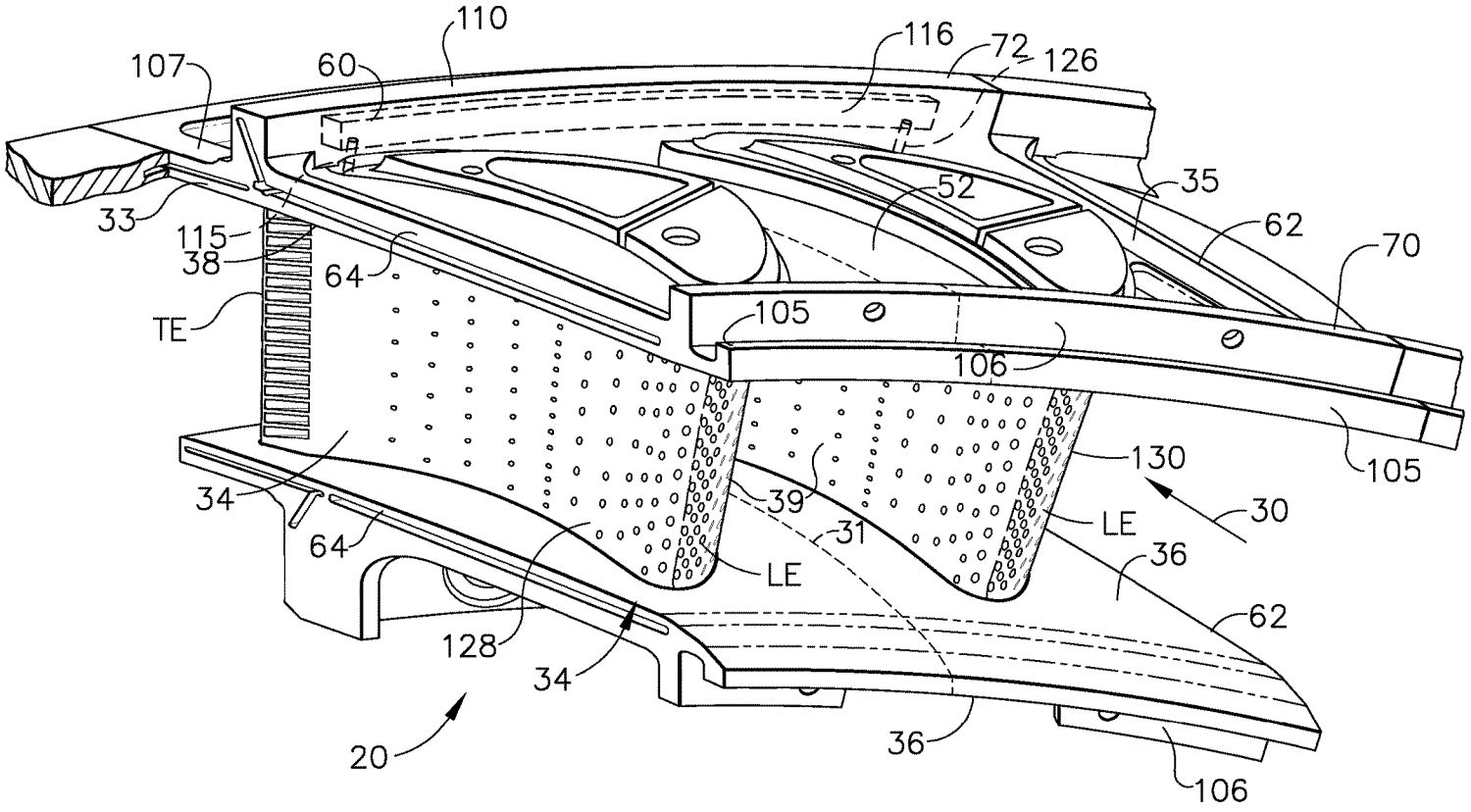
FIG. 7 is a perspective view illustration of the nozzle segment illustrated in FIG. 5.
Figure 8:
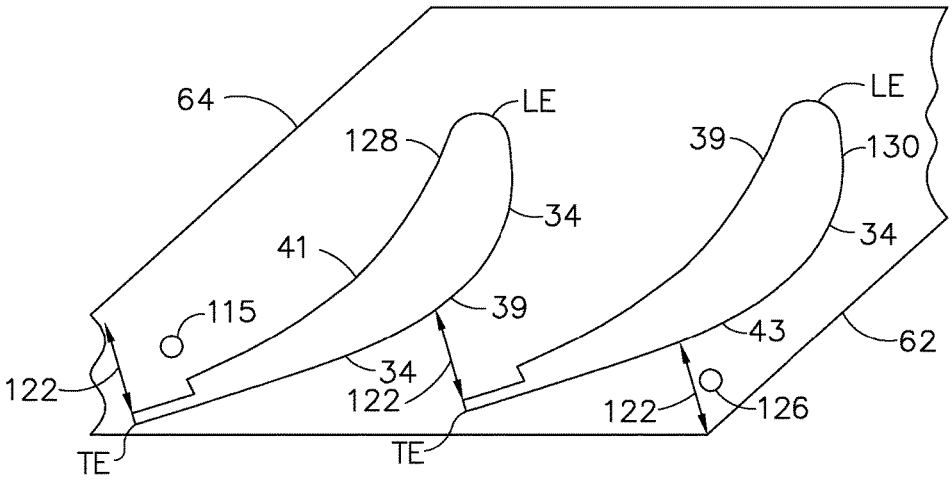
FIG. 8 is a schematic planform view illustration of a hot side of an outer band segment of the nozzle segment through 8-8 in FIG. 6.

FIG. 4A illustrates an alternative to the inserts 110 made of a different alpha material disclosed above and illustrated in FIGS. 2-4. Illustrated in FIG. 4A is a 360 degree segmented ring 214 including ring segments 216 made of a different alpha material and bonded or otherwise attached to the turbine nozzle segments 32 or the shroud segments 40. The ring segments 216 form, at least in part, the flanges and/or rail segments and provides the anti-chording means 60 for the flanges and/or rail segments. The arcuate ring segments 216 extend circumferentially between circumferentially spaced apart first and second edges 62, 64 of the arcuate shroud segments 40. The anti-chording ring segments 216 may be used with one or more of the flanges and rail segments disclosed above. The anti-chording ring segments 216 may be welded or otherwise bonded to the turbine nozzle segments 32 or the band segments 37, 38 or the shroud segments 40.

Illustrated in FIGS. 5-11 are exemplary embodiments of the anti-chording means 60 including heating means 112 for heating the relatively colder flanges and rail segments such as the forward and aft outer flanges 70, 72, the forward and aft inner flanges 106, 108, and the forward and aft shroud rail segments 80, 82 illustrated in FIGS. 1-4. Illustrated in FIGS. 5-11 are exemplary embodiments of the heating means 112 as applied to the aft outer flanges 72. The purpose of the heating means 112 is to better equalize the inner and outer band temperatures by heating the colder rail segments and flanges. By heating these structures, the band temperature gradients are reduced and chording is minimized. As chording is reduced, the stresses on the airfoils are significantly reduced as well.

Figure 9:
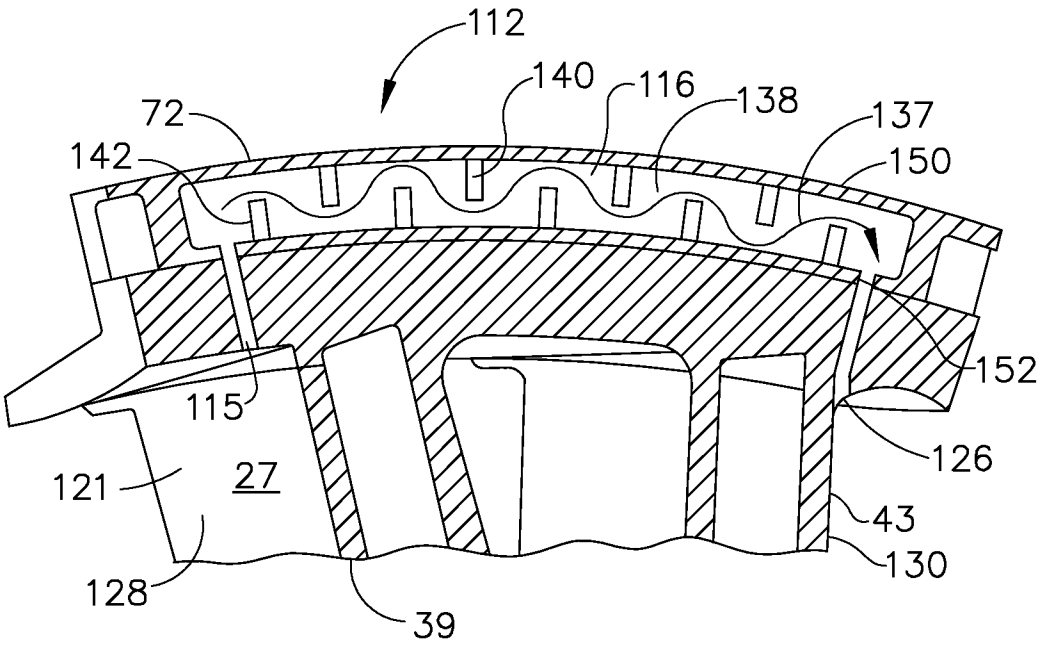
FIG. 9 is a partially cut away perspective view illustration of the flange illustrated in FIG. 5 with a serpentine heating flow passage.
Figure 10:
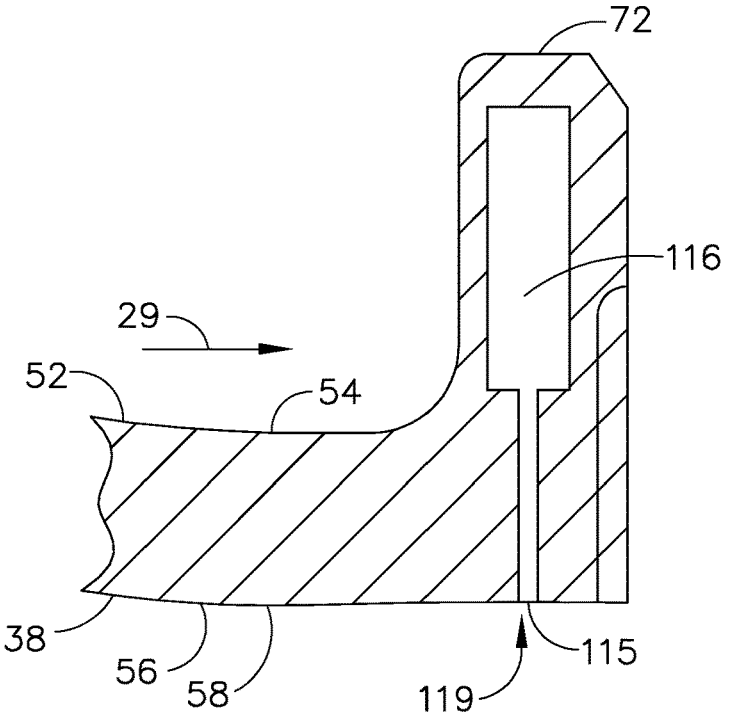
FIG. 10 is a cross-sectional view illustration of a hot air inlet to a heating flow passage in the flange illustrated in FIG. 4.
Figure 11:
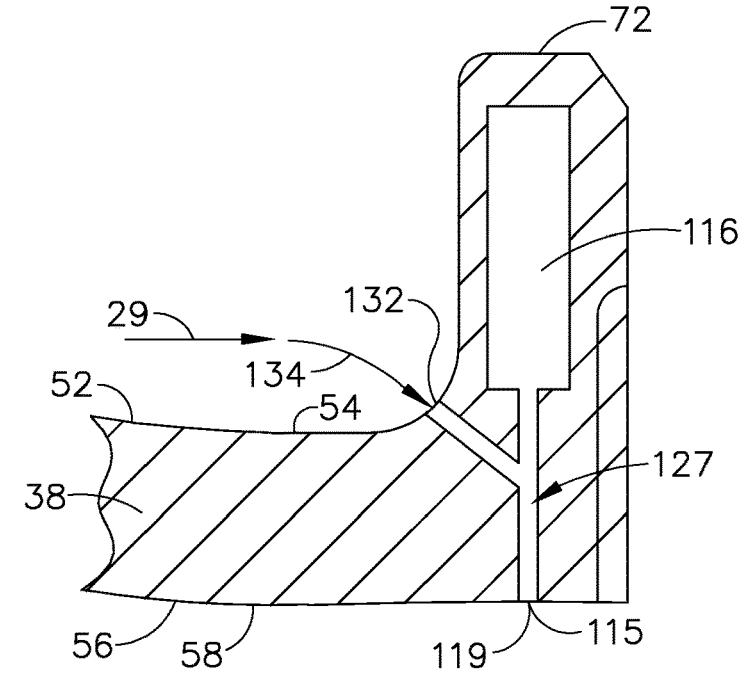
FIG. 11 is a cross-sectional view illustration of a hot air inlet and a cool air inlet to a heating flow passage in the flange illustrated in FIG. 4.

Referring to FIGS. 5-11, the heating means 112 includes a hot air inlet 115 to a circumferentially extending heating flow passage 116 embedded in the arcuate aft outer flange 72. The hot air inlet 115 allows a small amount of hot flowpath air 119, as illustrated in FIGS. 10 and 11, to flow into the passage 116 to warm the flange and decrease thermal gradient. The hot air inlet 115 is preferably located to extract or bleed a small amount of the hot flowpath air 119 upstream from a turbine nozzle throat 122 on a pressure side 121 of a trailing airfoil 128 to flow into the heating flow passage 116 for use as heating air 120. An outlet 126 allows the heating air 120 to exit the heating flow passage 116 upstream of the nozzle throat 122 potentially on a suction side 43 of a leading airfoil 130. The outlet 126 is preferably located to expel the heating air 120 into the turbine flowpath 27 on the suction side 43 of the leading airfoil 130, preferably forward but potentially aft of the turbine nozzle throat 122. The result is a warmer flange and less chording. The expelled heating air 120 can be used both for airfoil cooling supply and/or film cooling.

Referring to FIG. 11, the heating air 120 may be tempered or its temperature lowered by using a cold air inlet 132 to the heating flow passage 116 to allow cool air 134 that is cooler than the hot flowpath air 119 to mix with the hot flowpath air 119 to form the heating air 120 in the heating flow passage 116. The cold air inlet 132 and the hot air inlet 115 are operable to moderate the temperature of the heating air 120 in the heating flow passage 116. The hot flowpath air 119 is taken through the hot air inlet 115 on the hot surface 56 along an inner side 58 of the outer band segment 38 as illustrated for a single hot air inlet 115 in FIG. 10 and a double hot air inlet 127 in FIG. 11. The relatively cold cooling air 29 produces a cold surface 52 along an outer side 54 of the outer band segment 38 and provides the cool air 134 as illustrated in FIG. 11. Alternatively, previously utilized or spent cooling air from the airfoil internal cooling circuit which has increased in temperature may be flowed into the heating flow passage 116. One alternate source for flowing cooler air into the flow passages is spent turbine nozzle airfoil cooling.

A serpentine heating flow passage 138 may be used for the heating flow passage 116 as illustrated in FIG. 9. The serpentine heating flow passage 138 may be an undulating heating flowpath 137 which in the exemplary embodiment illustrated herein undulates between alternating upper and lower ribs 140, 142 extending downwardly and upwardly from upper and lower walls 150, 152 respectively bounding the serpentine heating flow passage 138. The serpentine heating flow passage 138 provides improved heat transfer for the heating flow passage. Alternative embodiments of the serpentine heating flow passage 138 may include pins and alternative turbulators etc.

Figure 12:
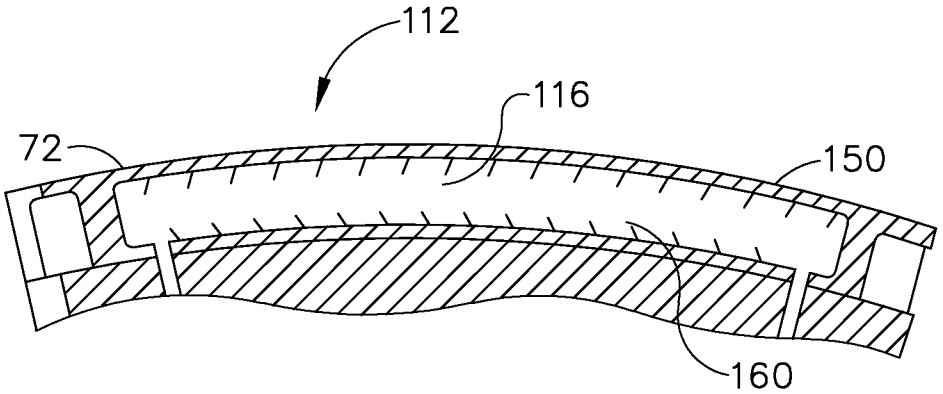
FIG. 12 is a partially cut away perspective view illustration of the flange illustrated in FIG. 5 with turbulators in the heating flow passage.
Figure 13:
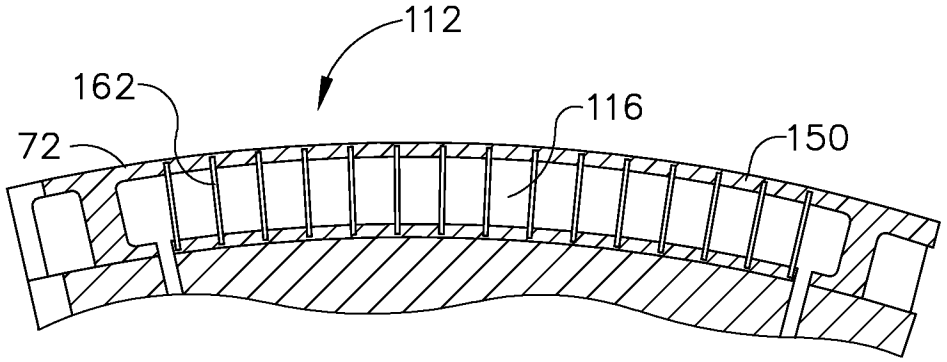
FIG. 13 is a partially cut away perspective view illustration of the flange illustrated in FIG. 5 with pins in the heating flow passage.

Alternatively, turbulators 160 may be used in the heating flow passage 116 as illustrated in FIG. 12. The turbulators 160 extend downwardly and upwardly from the upper and lower walls 150, 152 respectively bounding the heating flow passage 116. The turbulators 160 provide improved heat transfer for the heating flow passage 116. Another alternative embodiment of the heating flow passage 116 includes pins 162 extending across the heating flow passage 116 and may extend between the upper and lower walls 150, 152.

The inner and outer arcuate band segments 37, 38 and the shroud segments 40 are annular walls. The forward and aft shroud rail segments 80, 82 are particular embodiments of flanges within the context of this patent. Thus, the forward and aft shroud rail segments 80, 82 may be generally describes or referred to as flanges extending radially outwardly from the annular walls. The forward and aft outer flanges 70, 72 may be generally describes or referred to as flanges extending radially outwardly from the annular walls. The gas turbine engine arcuate segment 33 disclosed herein may be described comprising an arcuate flange 72 extending radially away from an annular wall and anti-chording means 60 for countering chording disposed in or bonded to the flange.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed:

1. A gas turbine engine arcuate segment comprising an arcuate flange extending radially away from an annular wall and the flange including an anti-chording means for counteracting chording;

the anti-chording means including one or more arcuate inserts in or bonded to the flange and the one or more arcuate inserts being made of a different alpha material than that of the annular wall wherein alpha is a coefficient of thermal expansion;

further comprising the one or more arcuate inserts extending axially all the way through the flange.

2. The gas turbine engine arcuate segment as claimed in claim 1, further comprising the one or more arcuate inserts extending radially to a perimeter of the flange.

3. The gas turbine engine arcuate segment as claimed in claim 1, further comprising the one or more arcuate inserts having a dovetail shape and disposed in one or more dovetail slots in the flange circumferentially between two dovetail posts of the flange.

4. The gas turbine engine arcuate segment as claimed in claim 1, further comprising:

the gas turbine engine arcuate segment being a turbine nozzle segment, one or more airfoils extending radially between inner and outer arcuate band segments of the turbine nozzle segment, arcuate forward and aft outer flanges extending radially outwardly from the outer arcuate band segment at corresponding forward and aft ends respectively of the outer band segment wherein the forward and aft outer flanges include the flange, and each of the forward and aft outer flanges including one of the anti-chording means.

5. The gas turbine engine arcuate segment as claimed in claim 4, further comprising arcuate forward and aft inner flanges extending radially inwardly from the inner arcuate band segment at corresponding forward and aft ends respectively of the inner band segment and at least one of the forward and aft inner flanges including a corresponding one of the anti-chording means.

6. A turbine nozzle comprising an arcuate segment as claimed in claim 1.

7. A gas turbine engine arcuate segment comprising an arcuate flange extending radially away from an annular wall and the flange including an anti-chording means for counteracting chording;

further comprising the anti-chording means including a heating means for heating the arcuate flange;

further comprising the heating means including a circumferentially extending heating flow passage embedded in the arcuate flange, a hot air inlet to the circumferentially extending heating flow passage, and an outlet from the circumferentially extending heating flow passage, and further comprising:

a cold air inlet to the circumferentially extending heating flow passage, the hot and cold air inlets operable to flow heating air through the heating flow passage, and the hot air inlet and the cold air inlet operable to moderate a temperature of the heating air in the heating flow passage.

8. The gas turbine engine arcuate segment as claimed in claim 7, further comprising alternating upper and lower ribs extending downwardly and upwardly from upper and lower walls respectively bounding the serpentine heating flow passage.

9. A gas turbine engine arcuate segment comprising an arcuate flange extending radially away from an annular wall and the flange including an anti-chording means for counteracting chording;

further comprising the anti-chording means including a heating means for heating the arcuate flange;

further comprising the heating means including a circumferentially extending heating flow passage embedded in the arcuate flange, a hot air inlet to the circumferentially extending heating flow passage, and an outlet from the circumferentially extending heating flow passage, and further comprising the circumferentially extending heating flow passage being a serpentine heating flow passage with an undulating heating flowpath.

10. A gas turbine engine arcuate segment comprising an arcuate flange extending radially away from an annular wall and the flange including an anti-chording means for counteracting chording;

further comprising the anti-chording means including a heating means for heating the arcuate flange;

further comprising the heating means including a circumferentially extending heating flow passage embedded in the arcuate flange, a hot air inlet to the circumferentially extending heating flow passage, and an outlet from the circumferentially extending heating flow passage, and further comprising the heating means including turbulators or pins extending downwardly and upwardly from the upper and lower walls respectively bounding the heating flow passage.

11. A gas turbine engine arcuate segment comprising an arcuate flange extending radially away from an annular wall and the flange including an anti-chording means for counteracting chording;

the gas turbine engine arcuate segment being an arcuate turbine shroud segment including forward and aft shroud rail segments extending radially outwardly from the arcuate shroud band segment wherein the forward and aft shroud rail segments include the flange, forward and aft shroud hooks on the forward and aft shroud rail segments, and the anti-chording means is disposed in at least one of the forward and aft shroud rail segments;

the anti-chording means including an arcuate insert in the at least one of the forward and aft shroud rail segments and the arcuate insert being made of a different alpha material than that of the arcuate shroud band segment wherein alpha is a coefficient of thermal expansion;

further comprising the arcuate insert having a dovetail shape and disposed in a dovetail slot in at least one of the forward and aft shroud rail segments, circumferentially between two dovetail posts of the at least one of the forward and aft shroud rail segments.

12. The gas turbine engine arcuate segment as claimed in claim 11, further comprising the arcuate insert including at least one of the forward and aft shroud hooks.

* * * * *